US005554954A

United States Patent [19]

Takahashi

[11] Patent Number: 5,554,954

[45] Date of Patent: Sep. 10, 1996

[54] CIRCUIT FOR BIASING FET AMPLIFIER WITH SINGLE POWER SUPPLY

[75] Inventor: Hideaki Takahashi, Tokyo, Japan

[73] Assignee: NEC Corporation, Tokyo, Japan

[21] Appl. No.: 358,593

[22] Filed: Dec. 14, 1994

[30] Foreign Application Priority Data

Dec. 16, 1993 [JP] Japan ..... 5-317025

[51] Int. Cl.[6] ..... G05F 3/02

[52] U.S. Cl. ..... 327/546; 327/427; 327/430; 327/431; 327/432

[58] Field of Search ..... 327/389, 427, 327/430, 431, 538, 545, 546, 432, 540, 541, 543, 390, 589; 307/126, 130

[56] References Cited

U.S. PATENT DOCUMENTS

| | | | |
|---|---|---|---|
| 3,140,408 | 7/1964 | May | 327/389 |
| 3,742,830 | 7/1973 | Matsuzaki et al. | 327/427 |
| 4,605,866 | 8/1986 | Conn | 327/431 |
| 5,134,323 | 7/1992 | Congdon | 327/430 |
| 5,361,007 | 11/1994 | Ohta | 327/427 |
| 5,371,415 | 12/1994 | Dixon et al. | 327/109 |
| 5,396,132 | 3/1995 | Shiga | 327/113 |
| 5,442,562 | 6/1995 | Mammano et al. | 327/538 |

*Primary Examiner*—Terry Cunningham
*Attorney, Agent, or Firm*—Foley & Lardner

[57] ABSTRACT

A power supply circuit disclosed herein includes a three-terminal regulator for stabilizing a positive voltage applied thereto, a voltage converter for converting the stabilized voltage into a negative voltage, a power-supply section for stabilizing a voltage by a light-emitting diode, and a control circuit for applying a bias voltage across a drain and source of a GaAs FET amplifier only when a voltage is being applied across the gate and source of the amplifier. When power is introduced from a power supply, the presence of the negative voltage supplied from the voltage converter is sensed by the control circuit and a bias begins to be applied to the gate. Therefore, when it is sensed that a predetermined voltage is applied to the gate, a bias begins to be applied to the drain of the FET thereafter. When power from the power supply is cut off, a drop in voltage is sensed and the drain bias begins being cut off while the gate bias for the FET is cut off thereafter.

9 Claims, 3 Drawing Sheets

CIRCUIT FOR BIASING FET AMPLIFIER WITH SINGLE POWER SUPPLY

BACKGROUND OF THE INVENTION

1. Field of the Invention

This invention relates to a power supply circuit for biasing a field-effect transistor amplifier and, more particularly, to a power-supply circuit for biasing a GaAs (gallium arsenide) field-effect transistor amplifier with a single power supply in the same way as with a biasing system employing both positive and negative power supplies to raise efficiency and obtain higher reliability.

2. Related Art

In general, when use is made of a GaAs field-effect transistor (hereinafter referred to as a "FET"), a positive voltage must be applied across a drain and a source of the transistor after a negative voltage is applied across a gate and the source of the transistor. Further, a GaAs FET requires a negative power supply.

Accordingly, in order to operate a GaAs FET with a single power supply, a source resistor is inserted between the source and a ground and the gate potential is set lower than the source potential to obtain an effect that is equivalent to the application of a negative voltage to the gate. With this biasing method, however, loss is produced owing to the source resistor and a decline in gain is incurred as a result.

In addition, in the case of a power GaAs FET for generating a high-power output, an arrangement is available in which the source is grounded to a case within the device to strengthen a ground pass and improve the heat radiating property. However, this structure prohibits the insertion of the source resistor.

Since most semiconductor devices presently manufactured are so designed as to operate using a single power supply system, a circuit system for biasing the GaAs FET amplifier with a single power supply is needed in order to achieve conformity with such devices.

One of conventional methods for biasing a GaAs FET, uses both positive and negative power supplies. As shown in FIG. 1, this conventional method relies upon drain biasing, in which a positive voltage from a positive power supply 6 is applied to the drain of a GaAs FET 3 through a choke coil 1, as well as gate biasing, in which a negative voltage from a negative power supply 7 is applied to the gate of the GaAs FET 3 through a choke coil 2. The source of the GaAs FET 3 is grounded. The drain and gate biasing voltages are blocked by coupling capacitors 4 and 5, respectively, so as not to apply the voltages to the outside.

Another conventional biasing method is biasing a GaAs FET by a single power supply, as illustrated in FIG. 2. According to this method, drain bias from a positive power supply 6 is applied to the drain of the GaAs FET 3 via the choke coil 1, the gate is grounded via the choke coil 2 and the source is grounded via a source resistor 8. The drain and gate biasing voltages are blocked by the coupling capacitors 4 and 5, respectively, so as not to apply the voltages to the outside.

GaAs FETs having excellent characteristics in the microwave band have been developed and are finding widespread use. Recently, with the development of the quasi-microwave band in mobile communications and the like, utilization of GaAs FETs in this band has shown great promise. In order to utilize a GaAs FET in mobile communications, both low power consumption and high efficiency are required. Further, such a function as to allow the power supply for amplifiers to be cut off when unnecessary is desirable in order to conserve the battery.

With the conventional biasing system employing two power supplies shown in FIG. 1, the efficiency of the amplifier is high but both positive and negative voltages are required as the biasing voltages. With regard to the circuit elements other than the amplifier, almost all of them are operated by a single power supply of +5V or +3V. Accordingly, this biasing system which requires both positive and negative power supplies is not effective in consideration of the coexistence with the circuits operating on a single power supply.

With the conventional biasing system shown FIG. 2, employing one power supply, only the positive biasing power supply suffices. However, since the source resistor 8 is inserted between the source and ground, the amount of loss is large. If the GaAs FET is utilized as an amplifier, the source resistor 8 deteriorates the gain of the amplifier to reduce efficiency. Moreover, in recently designed and manufactured high-power devices, since the source is grounded to a case within the device in order to enhance the capability for heat radiation and to strengthen the ground pass, the source resistor cannot be inserted.

Further, when bias is applied to a GaAs FET, it is necessary to apply the gate bias before applying the drain bias. Since the input impedance of a GaAs FET is very high, applying the drain bias before the gate bias may result in gate-source biasing owing to electrostatic induction or the like. This can result in the GaAs FET being driven into conduction and can lead to destruction of the device in a worst case.

With the above-described conventional biasing system, employing a single power supply is such that the gate bias is not applied unless the drain bias is applied. As a consequence, the device may likely be destructed in applications where the power supply is turned on and off frequently.

If the above-described timing sequence for biasing the GaAs FET is to be implemented in the conventional biasing system that relies upon two power supplies controlling the timing at which bias is applied is complicated enlarges the circuit size.

SUMMARY OF THE INVENTION

It is therefore an object of the present invention to provide a power-supply circuit capable of operating a GaAs FET amplifier by a single power supply and making the biasing operation the same as that of a biasing system employing both positive and negative power supplies, whereby it is possible to raise efficiency and obtain higher reliability.

A power supply circuit according to the present invention is featured by comprising an input terminal for receiving a power supply voltage, a drain-voltage output terminal for biasing a drain of the FET amplifier, a gate-voltage output terminal for biasing a gate of the FET amplifier, a source-voltage output terminal being connected to ground potential for supplying a ground potential to a source of the FET amplifier, switching means provided between the input terminal and the drain-voltage output terminal, a voltage converter receiving a voltage from the input terminal and outputting a voltage having an inverted polarity with respect to the voltage received to the gate-voltage output terminal, and circuit means sensing the voltage outputted from the voltage converter and rendering the switching means to a conductive state in response to the presence of the voltage having the inverted polarity.

BRIEF SUMMARY OF THE DISCLOSURE

In operation of the present invention, a positive voltage is applied to an input terminal of the GaAs FET amplifier when power is introduced from the power supply.

A three-terminal regulator which is preferably provided between the input terminal and output terminal for providing the drain bias stabilizes the voltage applied thereto from a power supply, and supplies a stabilized positive voltage to the voltage converter to generate a negative voltage.

When a negative voltage is generated by the voltage converter, a PNP transistor (Q1) preferably arranged in an emitter follower configuration and provided in an output path between the voltage converter and an output terminal for providing a gate bias, is rendered conductive so that the base voltage level of the PNP transistor (Q1) is fed to the output terminal as the gate bias.

This gate voltage $V_{GG}$ applied to the gate of the GaAs FET amplifier may be varied by regulating a voltage stabilizer preferably composed of a light-emitting diode.

If the circuit means detects the presence of the negative voltage having the predetermined level, it begins to supply a signal to render a switching means to a conductive state.

The switching means is preferably made up of a switching transistor formed of a P-channel power MOSFET and provided in a current-supply path from the three-terminal regulator to a drain-voltage output terminal.

As a result, the drain voltage of the switching transistor is applied to the output terminal to provide the drain bias $V_{DD}$.

When the power supply is turned off, the switching transistor provided in the current-supply path for biasing the drain of the GaAs FET, is at first cut off, and then the PNP transistor (Q1) provided in the path for biasing the gate is rendered non-conductive.

As a result of the above described operation sequence, the relationship between the gate-voltage output terminal $V_{GG}$ and the drain-voltage output terminal $V_{DD}$ accomplishes an ideal voltage-application relationship of the kind as shown in FIG. 5.

Further, the FET amplifier can be used just as if it is operated under a single power supply system to enhance the compatibility with generally used devices operated under a single positive power supply system.

The ideal voltage application sequence applied to the amplifier realized by the present invention makes it possible to improve reliability in a device such as a portable telephone in which the bias of the amplifier is turned on and off frequently in order to extend battery life.

BRIEF DESCRIPTION OF THE DRAWINGS

The foregoing and other objects, features, and advantages of the invention will be apparent from the following more particular description of preferred embodiments of the invention, as illustrated in the accompanying drawings, in which.

DESCRIPTION OF THE PREFERRED EMBODIMENT

In order that the invention may be fully understood, a preferred embodiment thereof will now be described with reference to FIGS. 3, 4 and 5.

Figure 1:
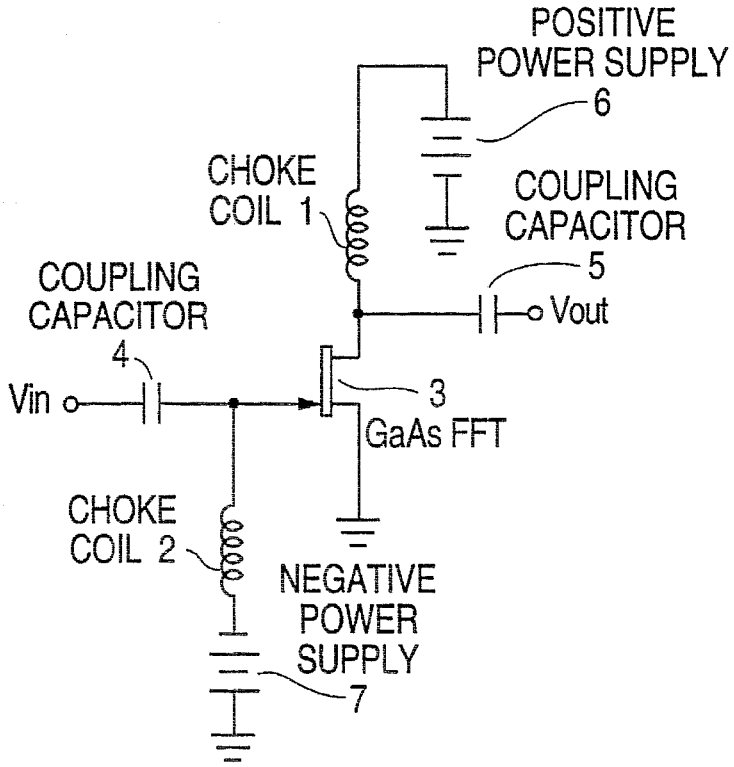
FIG. 1 PRIOR ART
FIG. 1 is a circuit diagram showing the circuit arrangement of a biasing method using two power supplies in an example of the prior art.
Figure 2:
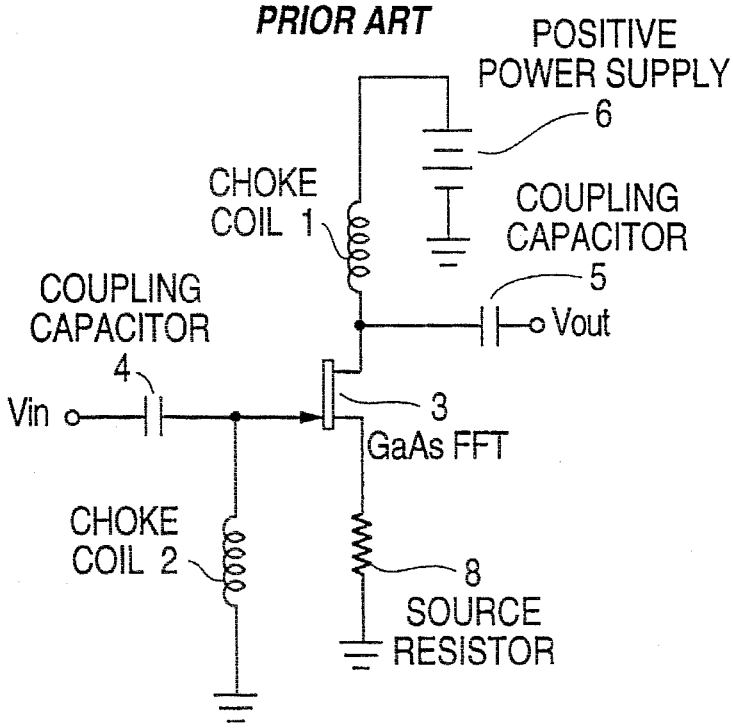
FIG. 2 PRIOR ART
FIG. 2 is a circuit diagram showing the circuit arrangement of a biasing method using one power supply in an example of the prior art.
Figure 3:
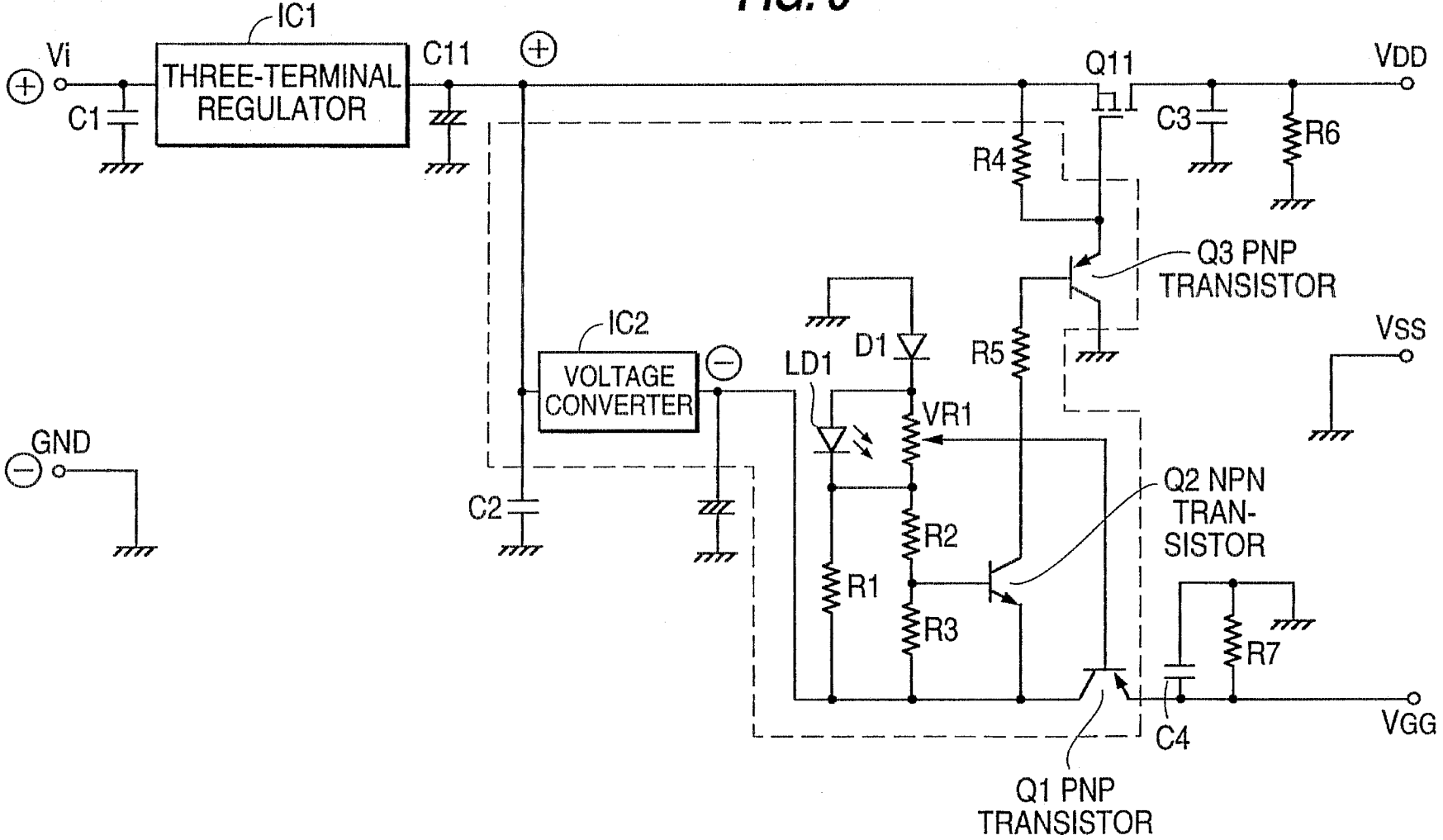
FIG. 3 is a circuit diagram showing the circuit arrangement of a power-supply circuit according to an embodiment of the present invention.

As shown in FIG. 3, the power-supply circuit of the present embodiment has an input terminal Vi to which an input voltage that is positive with respect to a ground terminal GND is applied, a drain-voltage output terminal $V_{DD}$ for supplying a positive voltage to a drain of a FET (not shown), a gate-voltage output terminal $V_{GG}$ for supplying a negative voltage to a gate of the FET, and a source-voltage output terminal $V_{SS}$ connected to ground potential.

The power-supply circuit comprises a P-channel power MOSFET Q11 operating as a switching element in the current-supply path from the input terminal Vi to the drain-voltage output terminal $V_{DD}$, a voltage converter IC2 generating a negative voltage from a positive voltage on the power-supply side of the P-channel power MOSFET Q11 as a power supply and providing this negative voltage to the gate-voltage output terminal $V_{GG}$, a PNP transistor Q3 operating as a circuit for applying a potential, which places the P-channel power MOSFET Q11 in a non-conductive state, to the control electrode of the P-channel power MOSFET Q11 in the absence of an output negative voltage from the voltage converter IC2, and a three-terminal regulator IC1 receiving the voltage from the input terminal Vi as an input to generate a regulated output voltage applied to a drain of the FET.

Furthermore, an emitter-follower type PNP transistor Q1 is inserted in the output path of the voltage converter IC2.

The P-channel power MOSFET Q11 is a semiconductor switching element whose control electrode is biased to a positive potential by a resistor R4.

The emitter-grounded-type PNP transistor Q3 which controls ON/OFF of the P-channel power MOSFET Q11, is rendered non-conductive to hold the MOSFET Q11 in an OFF state when there is no output negative voltage from the voltage converter IC2.

When there is an output negative voltage from the voltage converter IC2, the PNP transistor Q3 is rendered conductive to connect the control electrode of the P-channel power MOSFET Q11 to ground potential. The base potential of the grounded-emitter-type PNP transistor Q3 is biased by the output negative voltage from the voltage converter IC2.

Figure 4:
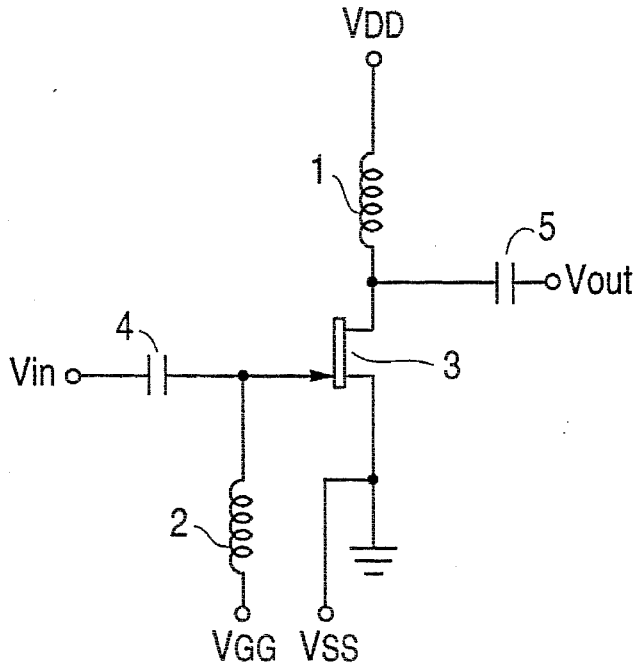
FIG. 4 is a circuit diagram showing an example of the circuit arrangement of a GaAs FET amplifier driven by a power-supply device according to the embodiment of the invention.

Referring to FIG. 4, a positive voltage from the drain-voltage output terminal $V_{DD}$ is applied to the drain of a GaAs FET 3 via a choke coil 1 and a negative voltage from the gate-voltage output terminal $V_{GG}$ is applied to the gate of the GaAs FET 3 via a choke coil 2 in the operation sequence described below. The source of the GaAs FET 3 is grounded.

The circuit operation of the present embodiment is now explained.

When power is introduced from the power supply, namely when a positive voltage is applied to the input terminal Vi, the three-terminal regulator IC1, regulating the output voltage from the power supply applied thereto, generates a stabilized positive voltage $+\overline{V}$. The voltage converter IC2 receives this positive voltage $+\overline{V}$ to convert it to a negative voltage $-\overline{V}$ of the same magnitude as the positive voltage $+\overline{V}$.

When the output negative voltage from the voltage converter IC2 reaches to a predetermined level (approximately −0.7V) sufficient to turn on a diode D1, the PNP transistor Q1 begins to conduct. As the current flowing through the diode D1 subsequently increases, so does a negative current flowing through the PNP transistor Q1.

When current begins to flow into a light-emitting diode LD1, the voltage across the anode and cathode terminals of the light-emitting diode is maintained as a forward voltage (approximately 1.8V). Thus, this circuit arrangement operates as a constant-voltage source.

The light-emitting diode LD1 is preferably employed for the following reasons. Rather than employing the light-emitting diode LD1 several diodes may be arranged in the forward direction or a Zener diode may be connected in the reverse direction. In the case where several diodes are used, however, the circuitry is enlarged in size since several diodes must be connected in series. In the case where the Zener diode is employed, Zener noise is produced to become a source of noise in the circuitry. These problems are eliminated if the light-emitting diode LD1 is used.

Further, if the light-emitting diode LD1 is used, it can also be utilized as a substitute for a power-supply indicator.

The base voltage of the PNP transistor Q1 can be varied from −0.7V to −2.5V by a variable resistor VR1.

Since the PNP transistor Q1 is arranged in an emitter-follower construction, the base voltage of the PNP transistor Q1 is applied directly to the gate-voltage output terminal $V_{GG}$. If it is desired to broaden the range over which the base voltage of the PNP transistor Q1 can be varied, the light-emitting diode LD1 may be serially arranged with a diode in the forward direction.

The NPN transistor Q2 is held in the non-conductive state until the negative voltage falls to a voltage (approximately −3.2V) at which the transistor Q2 is rendered conductive. When the negative output voltage from the voltage converter IC2 falls below this voltage, the transistor Q2 begins to conduct. In the meantime, the positive voltage $+\overline{V}$ is being applied to the emitter of the PNP transistor Q3, so that the PNP transistor Q3 also makes a rapid transition to the conductive state when the NPN transistor Q2 is rendered conductive. At the same time, the P-channel power MOSFET Q11 is rendered conductive so that the positive voltage $+\overline{V}$ is applied to the drain-voltage output terminal $V_{DD}$.

When power from the power supply is cut off, the P-channel power MOSFET Q11, the PNP transistor Q3, the NPN transistor Q2 and the PNP transistor Q1 undergo transitions from the conductive state to the non-conductive state respectively in the order mentioned.

Figure 5:
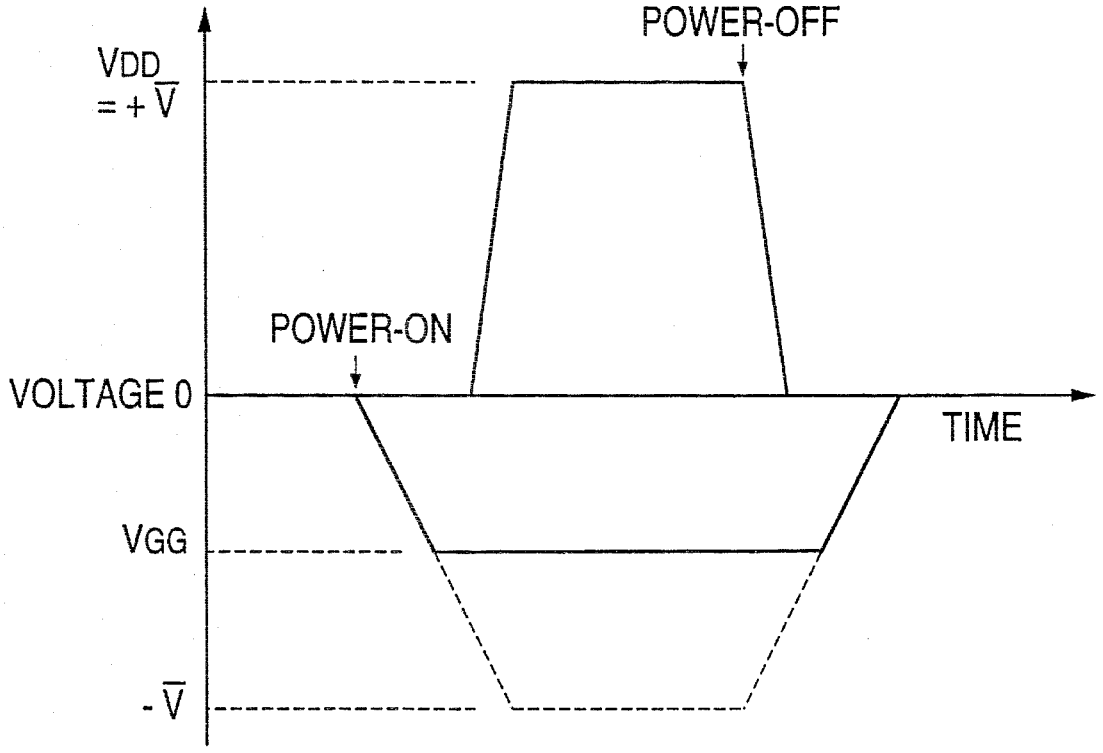
FIG. 5 is a diagram showing the states of a bias voltage in the embodiment of the invention.

Accordingly, the voltage relationship between the drain-voltage output terminal $V_{DD}$ and the gate-voltage output terminal $V_{GG}$ takes on an ideal voltage-application relationship of the kind shown in FIG. 5.

More specifically, as shown in FIG. 5, in the case of the power-on sequence, the positive voltage begins to be fed to the drain-voltage output terminal $V_{DD}$ when the negative voltage outputted from the voltage converter IC2 begins to turn on the diode D1 and transistor Q1 to render the P-channel MOSFET Q11 to the conductive state. In the case of the power-off sequence, the gate bias voltage $V_{GG}$ is cut off after the voltage of the drain-voltage output terminal $V_{DD}$ drops to the ground potential. The dashed line in FIG. 5 indicates the output negative voltage from the voltage converter IC2.

Thus, in accordance with the present invention as described above, power can be supplied to a GaAs FET amplifier merely by applying the power from a single power supply system, and the biasing can be made the same as that when both positive and negative power supplies are used. As a result, amplifier efficiency can be improved.

In addition, the reliability of the device can be enhanced since there is no longer any danger of device breakdown even if the power supply is turned on and off frequently. Furthermore, the power supply and switching sections (enclosed by the dashed line in FIG. 3) can be fabricated on a single chip. This makes it possible to reduce the overall size of the circuitry. It should be noted that this circuit is suitable for use in a portable telephone of the type in which the amplifier power supply is turned off frequently in order to conserve the battery.

As many apparently widely different embodiments of the present invention can be made without departing from the spirit and scope thereof, it is to be understood that the invention is not limited to the specific embodiments thereof except as defined in the appended claims.

What is claimed is:

1. A power supply circuit for supplying a bias to an FET amplifier comprising:

an input terminal for receiving a power supply voltage;

a drain-voltage output terminal for biasing a drain of the FET amplifier;

a gate-voltage output terminal for biasing a gate of the FET amplifier;

a source-voltage output terminal being connected to a ground potential for supplying the ground potential to a source of the FET amplifier;

switching means provided between the input terminal and the drain-voltage output terminal;

a voltage converter receiving a voltage from the input terminal and outputting a voltage, having an inverted polarity with respect to the voltage received, to the gate-voltage output terminal; and circuit means sensing the voltage outputted from the voltage converter and rendering the switching means to a conductive state in response to the presence of the voltage having the inverted polarity being of a predetermined potential.

2. The circuit as defined in claim 1, further comprising a three-terminal regulator, receiving a voltage from the input terminal and generating a positive voltage, said positive voltage being fed to said switching means and said voltage converter.

3. The circuit as defined in claim 1, wherein an emitter-follower type circuit configuration using a PNP type transistor is coupled in a path between said voltage converter and said gate-voltage output terminal.

4. The circuit as defined in claim 1, wherein said switching means comprises a semiconductor switching device.

5. The circuit as defined in claim 1, wherein said circuit means comprises at least a transistor, said transistor being turned on when the voltage outputted from said voltage converter reaches the predetermined potential to supply a control signal to said switching means for rendering said switching means to the conductive state.

6. The circuit as defined in claim 3, further comprising voltage stabilizing means for stabilizing the voltage having an inverted polarity to provide a bias at least to said emitter-follower type circuit configuration using a PNP type transistor.

7. The circuit as defined in claim 6, wherein said voltage stabilizing means comprises at least a light-emitting diode, said light-emitting diode being rendered conductive when the voltage having an inverted polarity is outputted from said voltage converter.

8. The circuit as defined in claim 3, wherein the circuit means comprises gate-voltage adjusting means for adjusting a base voltage provided to said PNP type transistor being used in said emitter-follower type circuit configuration.

9. The circuit as defined in claim 1, wherein the voltage having an inverted polarity at the gate-voltage output terminal begins to return to the ground potential after the voltage at the drain-voltage output terminal is restored to the ground potential when power is cut off.

* * * * *